United States Patent [19]

Springfield

[11] 4,133,579

[45] Jan. 9, 1979

[54] STADIUM, GYMNASIUM OR LIKE CHAIR

[75] Inventor: Billy J. Springfield, Temple, Tex.

[73] Assignee: American Desk Manufacturing Co., Temple, Tex.

[21] Appl. No.: 828,871

[22] Filed: Aug. 29, 1977

[51] Int. Cl.[2] ..... A47C 7/02

[52] U.S. Cl. ..... 297/452; 297/DIG. 2

[58] Field of Search ..... 297/452, 453, 457–460, 297/DIG. 2

[56] References Cited

U.S. PATENT DOCUMENTS

| | | | |
|---|---|---|---|
| 3,111,344 | 11/1963 | Hoven et al. | 297/DIG. 2 |
| 3,669,496 | 6/1972 | Chisholm | 297/DIG. 2 |

*Primary Examiner*—James C. Mitchell

*Attorney, Agent, or Firm*—Diller, Ramik & Wight

[57] ABSTRACT

This disclosure relates to a chair and, particularly, a seat therefor, which includes top and bottom walls merging with front, rear and a pair of opposite side walls, the seat being of a generally one-piece homogenous plastic blow-molded construction with a parting line along the front, rear and pair of opposite side walls, and portions of the top and bottom walls being compression fused to each other adjacent the side walls thereby forming reinforced areas adapted for securement to a conventional chair seat support bracket.

26 Claims, 18 Drawing Figures

STADIUM, GYMNASIUM OR LIKE CHAIR

A primary object of this invention is to provide a novel stadium, gymnasium or like chair which includes a back and hinged seat, the seat including top and bottom walls merging with front, rear and a pair of opposite side walls, the seat being of a generally one-piece homogenous plastic blow-molded construction with a parting line along the front, rear and pair of opposite side walls thereby rendering the construction of the seat relatively economical, and portions of the top and bottom walls being compression fused to each other adjacent the side walls thereby forming reinforced areas which strengthen the seat at points whereat the seat is secured to conventional chair seat support brackets.

A further object of this invention is to provide a novel seat of the type aforesaid including a generally U-shaped or A-shaped reinforcing valley formed from the material of the bottom wall opening in a direction away from the top wall, the valley having a bight and a pair of legs, the bight being adjacent the front wall, and the legs being directed toward the rear wall.

Yet another object of this invention is to provide a novel seat of the type aforesaid including another reinforcing valley formed from the material of the bottom wall opening in a direction away from the top wall, and the another reinforcing valley being disposed adjacent the rear wall.

Still another object of this invention is to provide a novel seat of the type heretofore described wherein said compression fused portions are a plurality of recesses in the bottom wall opening in a direction away from the top wall and being in spaced relationship to each other adjacent each of the side walls.

Still another object of this invention is to provide a novel seat of the type aforesaid including apertured means in the reinforced areas adapted to receive fasteners for securing the seat to a conventional chair seat bracket, and at least a pair of blow needle holes in the bottom wall disposed generally along a centerline of the bottom wall.

Another object of this invention is to provide a novel seat of the type aforesaid in combination with a back associated with a chair, the back likewise including front and back walls in generally spaced relationship and merging with top, bottom and a pair of opposite side walls and defining therewith a generally hollow chamber, the back being made of two injection molded elements, at least a pair of recesses formed by depressions in the material of the back wall adjacent each side wall, and a generally U-shaped valley formed from the material of the back wall in each recess opening in a direction away from the front wall thereby reinforcing the recesses for utilizing the latter to secure the back to a conventional chair back support bracket.

A further object of this invention is to provide a novel back of the type immediately aforesaid wherein the injection molded elements are enjoined to each other along a line of bond extending along the top, bottom and pair of opposite side walls, and the back wall includes a further depression within each U-shaped valley to form a reinforced area adapted to be apertured for the receipt therethrough of a conventional fastener.

With the above and other objects in view that will hereinafter appear, the nature of the invention will be more clearly understood by reference to the following detailed description, the appended claimed subject matter, and the several views illustrated in the accompanying drawings.

IN THE DRAWINGS

FIG. 1 is a perspective view of a chair constructed in accordance with this invention, and illustrates a back and hinged seat supported by conventional frames or standards bolted to a support surface.

FIG. 2, which appears on sheet 2 of the drawings, is a side elevational view of the seat, and illustrates the contoured configuration thereof.

FIG. 3, which appears on sheet 2 of the drawings, is a bottom view of the seat of FIG. 2, and illustrates details of reinforced areas for reinforcing the seat as well as the areas thereof which are adapted to be secured to conventional chair brackets.

FIG. 4 is a sectional view taken generally along line 4—4 of FIG. 3, and illustrates the cross-sectional configuration of the seat through the centerline thereof.

FIGS. 5 through 11 are enlarged half-sectional views taken generally along lines 5—5 through 11—11 of FIG. 2, and illustrate details of the seat including the manner in which sides of the seat are reinforced as well as portions of the seat bottom wall.

Figure 13:
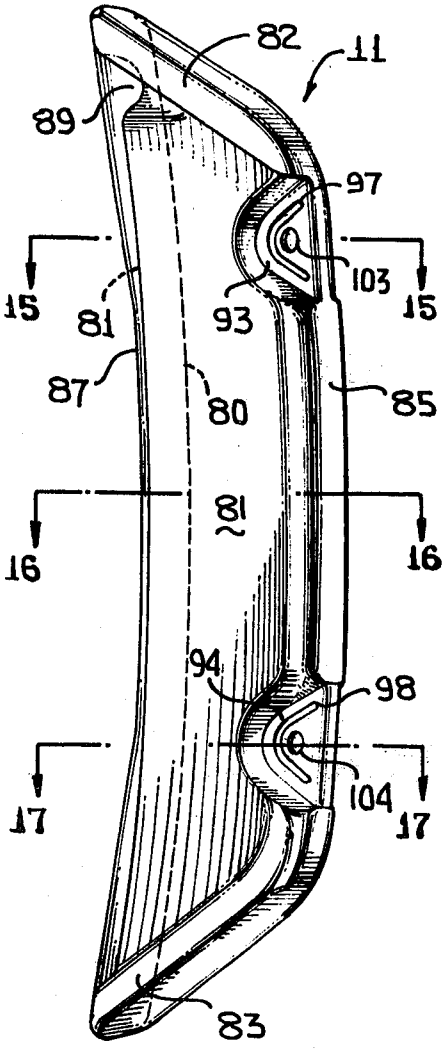
FIG. 13 is a side elevational view of the back of the chair of FIG. 1, and illustrates a pair of recessed portions formed in a back wall of the back for securing the same to conventional chair back brackets.
Figure 17:
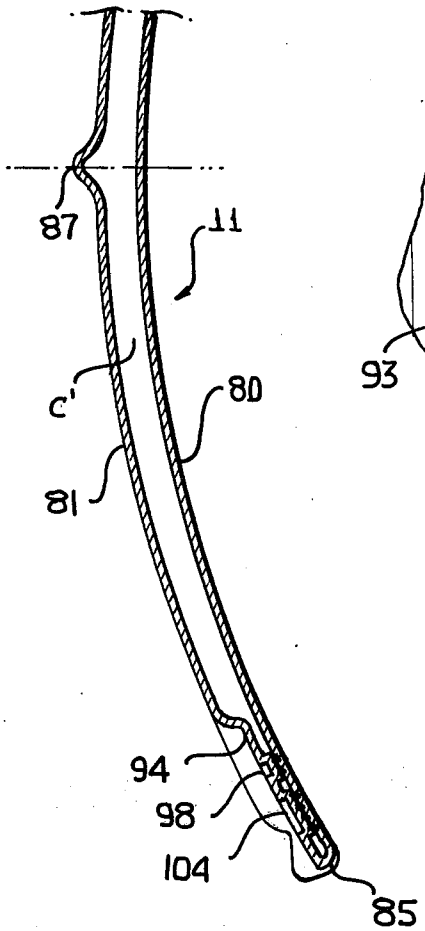
Figure 16:
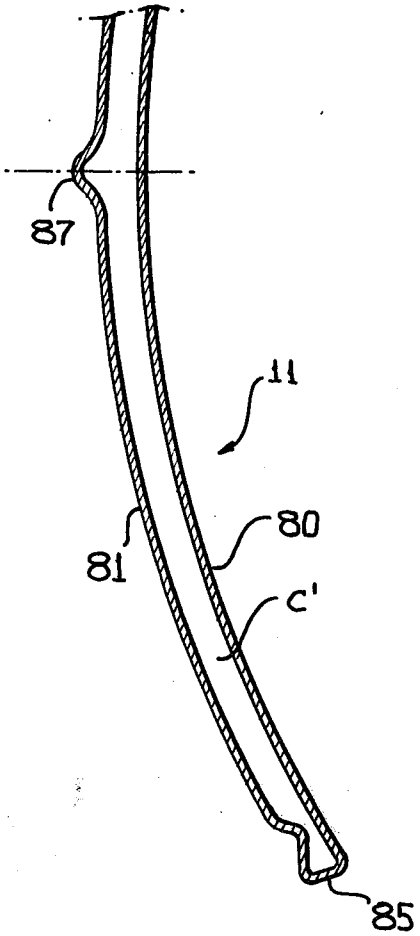
Figure 15:
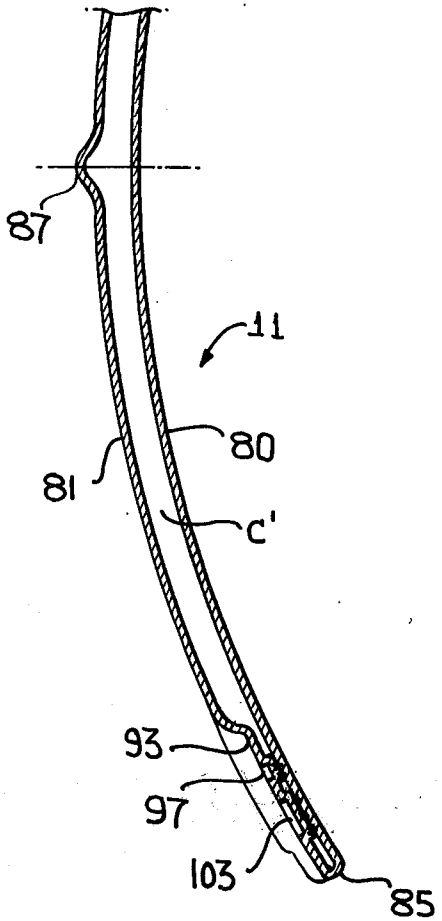

FIGS. 15 through 17 are fragmentary sectional views taken generally along lines 15—15 through 17—17 of FIG. 13, and illustrate details of the cross-sectional configuration of the back.

Figure 18:
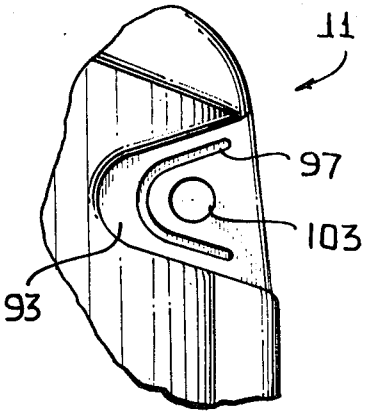

FIG. 18 is an enlarged fragmentary front view of one of the recesses and further illustrates the U-shaped reinforcing area and another reinforcing area within the U which is adapted to the aperture for receipt therethrough of a conventional fastener.

A chair 10 (FIG. 1) includes a back 11 secured by conventional fasteners 12 to four brackets (not shown) carried by conventional frames or standards 13, 14 which are, in turn, fastened by bolts 15 to a supporting surface S in a gymnasium, athletic stadium, or the like. A seat 16 is likewise fastened by suitable conventional fasteners 17 to conventional seat brackets 18 which are joined by hinges (unnumbered) to the frames 13, 14 to permit the seat 16 to be moved from the generally horizontal position shown in FIG. 1 to an upright position.

Figure 3:
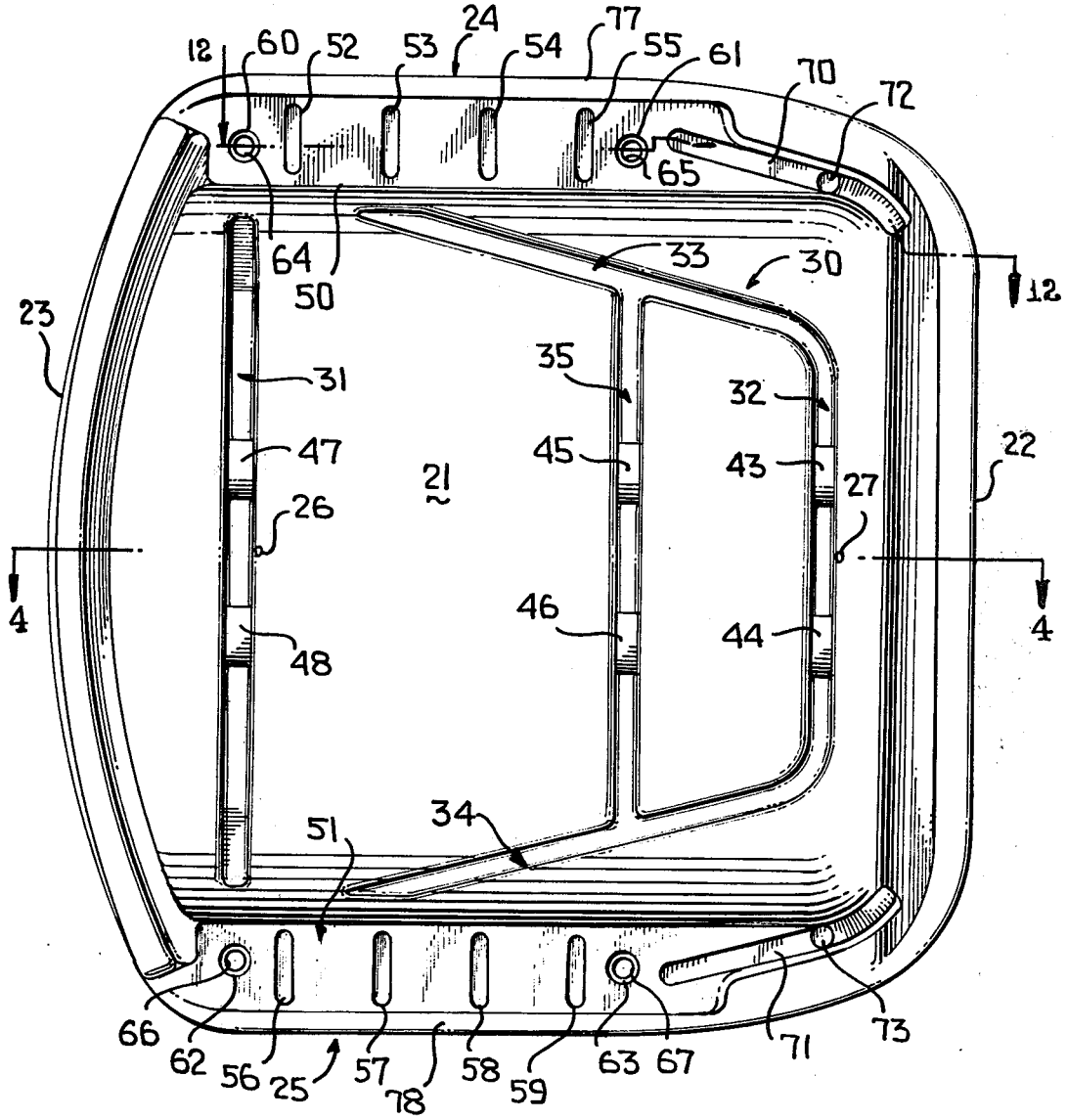
Figure 7:
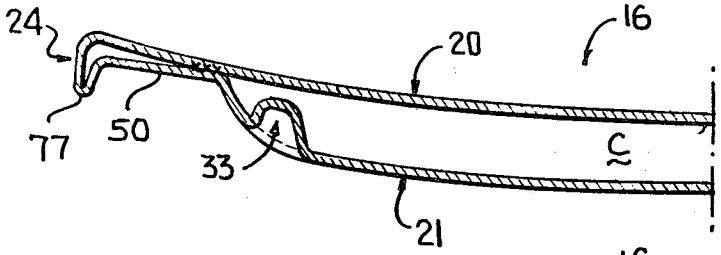
Figure 8:
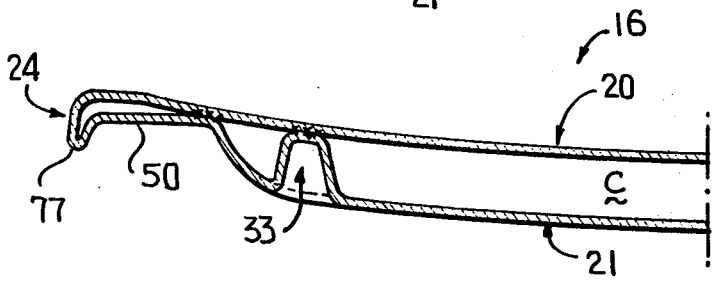
Figure 9:
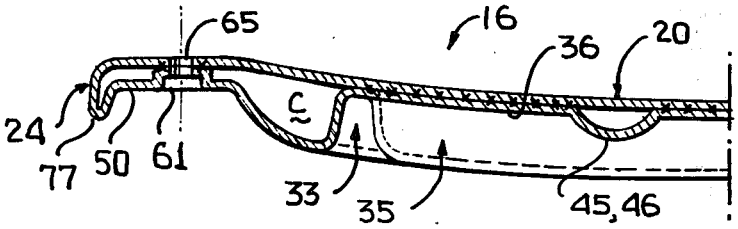
Figure 10:
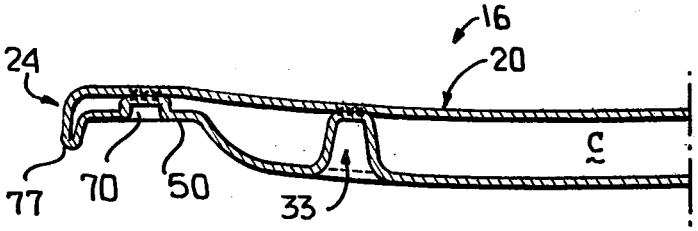

The seat 16 is fully illustrated in FIGS. 4 through 12 and includes a contoured top wall 20, a bottom wall 21, a front wall 22, a rear wall 23, and a pair of opposite side walls 24, 25 (FIG. 3).

The walls 20 through 25 define a generally hollow chamber C, and seat 16 is formed by an injection molding process by inserting a hollow or tubular parison in a two-piece mold which after being closed a pair of blow needles (not shown) penetrate the bottom wall 21 forming blow openings or blow holes 26, 27 (FIG. 3) through which air is introduced into the interior of the parison forcing the latter into intimate engagement with the walls of the blow-mold cavity thereby imparting the illustrated configuration to the seat 16. When the parison which is preferably constructed of heated polyethylene or like polymeric or copolymeric material is subjected to internal air pressure, the exterior of the seat 16 when forced into intimate contact with the cavity of the blow mold has impressed thereon a parting line or a line of flash F (FIG. 2) which extends along both of the side walls 24, 25 in the manner illustrated in FIG. 2 as well as across the front and rear walls 22, 23 at the flash lines F extending there across in the areas F, F of FIG. 4. Thus, the line of flash F runs completely around the periphery of the seat 16 along the walls 22 through 25.

During the closing of the blow mold, certain areas of the heated plastic parison are also moved toward each other and these areas to be described more fully hereinafter of the top wall 20 and the bottom wall 21 are subject to compressive forces which fuse portions of the inner surfaces (unnumbered) of the walls 20, 21 to each other to impart rigidity to the seat 16, again as will be described more fully hereinafter.

Reference is now made to FIG. 3 of the drawings which illustrates a generally A-shaped reinforcing valley 30, as viewed from the left, and another reinforcing linear valley 31. The valley 30 includes a bight 32, a pair of legs 33, 34 extending in the direction away from the front wall 22 and toward the rear or back wall 23, and a cross-arm 35. The A-shaped reinforcing valley 30 opens upwardly as viewed in FIG. 3 and downwardly as viewed in FIGS. 2 and 7 through 11 in a direction away from the top wall 20, as does the reinforcing valley 31. The reinforcing valleys 30, 31 thereby are also, in effect, ribs which are directed away from the bottom wall 21 toward the top wall 20 in the manner illustrated best in FIG. 4, and as is viewed in transverse cross section the A-shaped reinforcing valley is defined by a bight wall 36 and leg walls 37, 38 while the reinforcing valley 31 is likewise defined by a bight wall 40 and legs 41, 42. Discounting the cross-arm 35, the reinforcing valley 30 is of a generally U-shaped configuration. Due to the compression-molding heretofore mentioned during the injection-molding of the seat 16, those areas of the bight walls 36, 40 which contact the top wall 20 are fused thereto thereby imparting rigidity to the seat 16.

Figure 11:
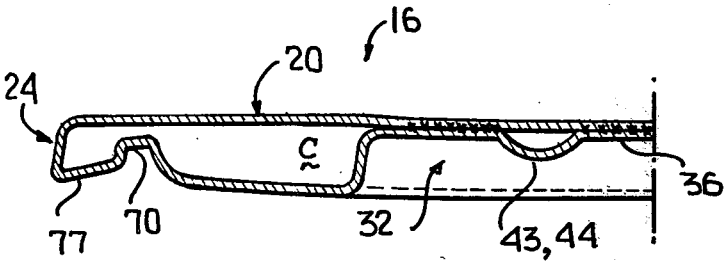

Two portions 43, 44 of the bight wall 36 of the bight 32 are spaced away from the top wall 20 and are generally of a semi-annular configuration as viewed in cross section (FIG. 11). Since the seat 16 is symmetrical through its longitudinal axis (cross-sectional line 4—4) reference numerals 43, 44 have both been applied to FIG. 11 of the drawings. Like semi-annular portions 45, 46 (FIGS. 3 and 9) of the bight wall 36 of the cross-arm 35 are spaced from the top wall 20 of the seat 16.

The linear reinforcing valley 31 likewise includes semi-annular wall portions 47, 48 (FIGS. 3 and 5) which likewise are not fused to the top wall 20.

The purposes of the semi-annular wall portions 43 through 48 is to permit air to flow freely within the chamber C during the blow molding of the seat 16, particularly, in the chamber area (unnumbered) circumscribed by the cross-arm 35, the bight 32 and portions of the legs 33, 34.

Figure 12:
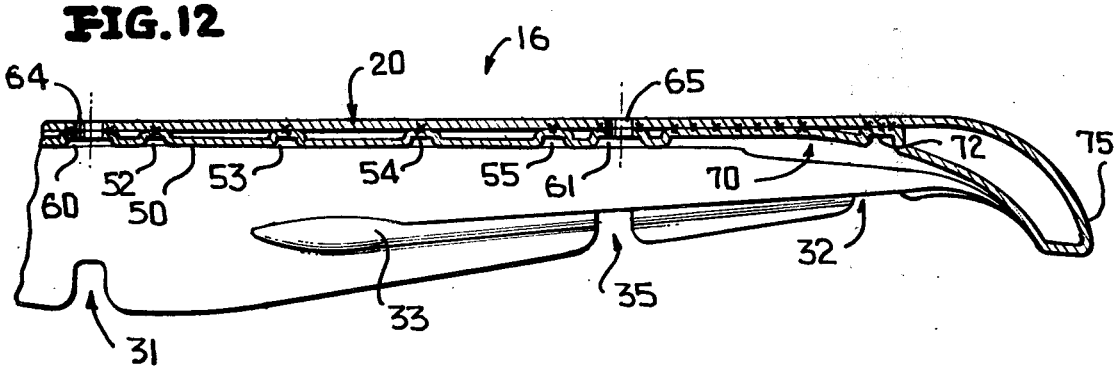
FIG. 12 is a sectional view taken generally along line 12—12 of FIG. 3, and illustrates details through a side edge of the seat which is adapted to be secured by conventional fasteners to a conventional seat bracket.
Figure 14:
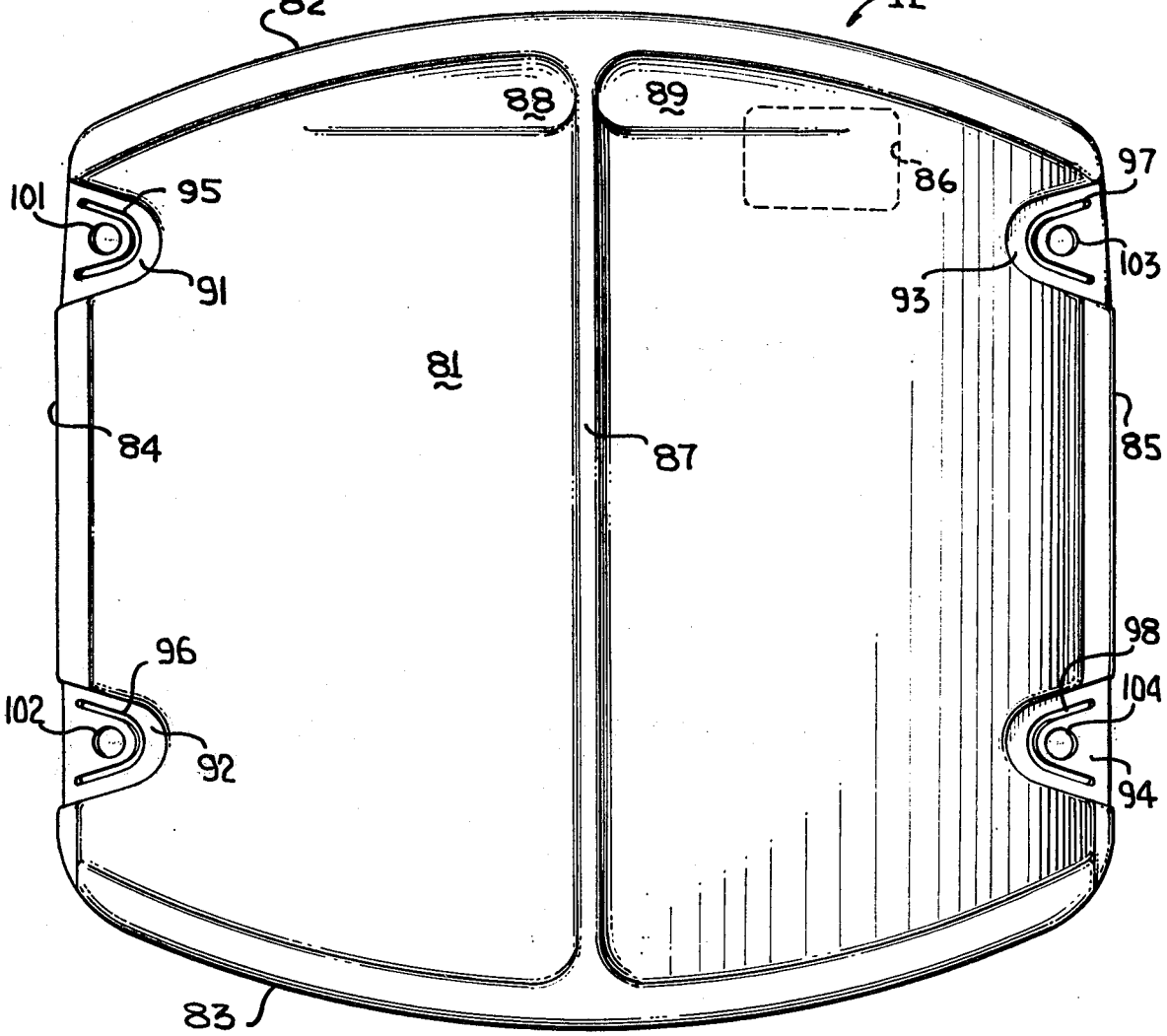
FIG. 14 is a view of the back of the back of FIG. 13, and illustrates four such recesses and generally U-shaped reinforcing areas associated therewith.

The legs 33, 34 converge toward the top wall 20 in a direction toward the front wall 22 in the manner best illustrated in FIG. 12 while terminal ends (unnumbered) of the linear reinforcing valley 31 also converge toward the top wall 20 from the ends thereof in a direction toward the semi-annular walls 47, 48.

The A-shaped reinforcing valley 30 and the linear reinforcing valley 31 thereby serve to rigidify or reinforce the seat 16 and this reinforcement is augmented by the fusion of the material of the bight walls 36, 40 and the top wall 20 of the reinforcing valleys 30, 31.

Figures 1, 4, 5, 6:
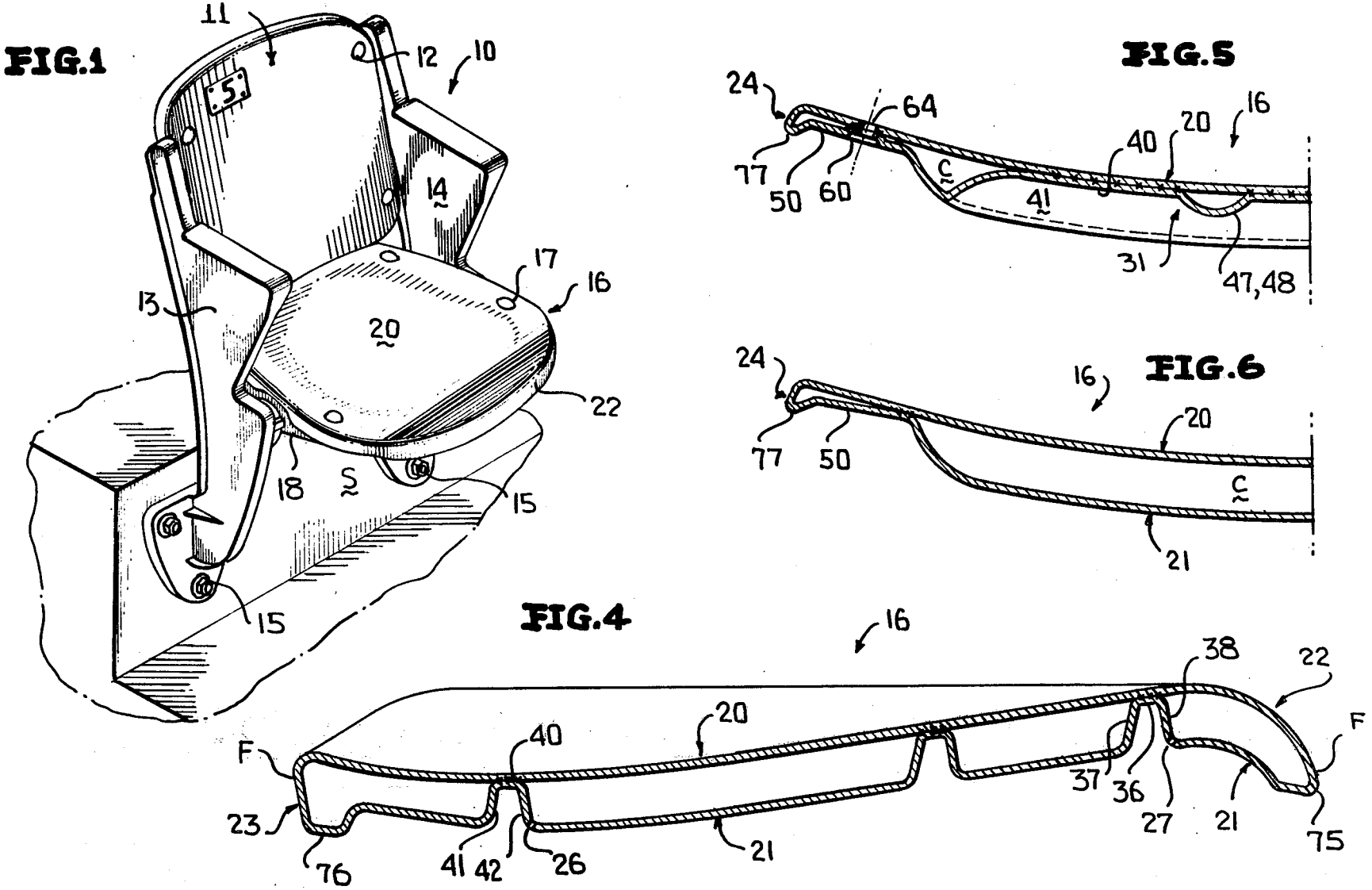

During the blow molding of the seat 16 heretofore described, generally rectangular portions 50, 51 (FIG. 3) of the bottom wall 21 are urged in intimate relationship with respect to the top wall 20 in the manner best illustrated in FIG. 12. The rectangular portions 50, 51 of the bottom wall 21 are generally in spaced relationship to the top wall 20 but four linear spaced depression or recesses 52 through 55 and 56 through 59 contact the undersurface of the top wall 20 (FIG. 12) and are fused thereto. Circular depressions 60, 61 of the recessed portion 50 and 62, 63 of the recessed portion 51 also contact and are fused to the undersurface of the top wall 20 and the latter circular depressions have respective circular apertures 64-65 and 66-67 through which pass the fasteners 17 (FIG. 1). At the right-hand end of each of the recessed portions 50, 51 of the bottom wall 21 are formed additional depressions 70, 71 each of which is additionally circularly recessed at 72, 73, respectively. A major portion of the depression 70, 71 are fused to the top wall 20 in the manner best illustrated in FIG. 12 as is each of the depressions 72, 73 (FIG. 12).

Figure 2:
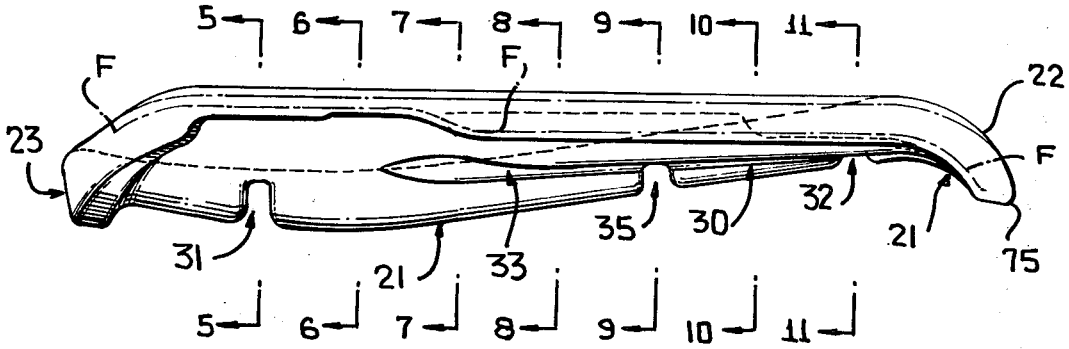

Portions of the front wall 22 and the bottom wall 21 are directed downwardly, as is best illustrated at the right-hand side of FIG. 4 to form a generally downwardly directed lip 75 (FIGS. 4 and 12) at the front (unnumbered) of the seat 16. Likewise, a rear portion (unnumbered) of the bottom wall 22 and the rear wall 23 form a downwardly directed lip or flange 76 along the rear (unnumbered) of the seat 16 (FIGS. 2 and 4). The side walls 24, 25 with down-turned portions (unnumbered) of the bottom wall 21 adjacent the recessed portions 50, 51 also define downwardly directed flanges 77, 78. Thus, the lips or flanges 75 through 78 generally surround the entire periphery of the seat 16 and impart reinforcement or rigidity thereto.

For purposes of clarity, the portions of the various walls which are compression-fused to each other, bear small x's in those Figures of the drawings which are in cross-section.

Reference is now made to FIGS. 13 through 18 of the drawings in which the back 11 is formed of a front wall 80 of slightly concave configuration, a back wall 81 similar in curvature to the front wall 80, a convexly curved top wall 82, a convexly curved bottom wall 83, and side walls 84, 85. The back or back rest 11 is formed of two vacuum-formed elements in which peripheral edges (not shown) of each abut and are bonded to each other along a line approximately at the mid portion of the top wall 82, the bottom wall 83 and the side walls 84, 85. Thus, the two elements are generally of a shallow dish-shaped configuration whose edges are in abutment, bonded to each other, and define a hollow chamber C'.

The front wall 80 is provided with a rectangular recess 86 (FIG. 14) into which is inserted a plate bearing a particular seat number.

An outwardly directed reinforcing rib 87 (FIG. 14) extends along the central vertical axis of the seat 11 and merges with the top wall 82 and the bottom wall 83. A pair of recesses 88, 89 are formed in the back wall 81 to either side of the rib 87 adjacent the top wall 82.

The back wall 81 also includes four recesses 91 through 94 (FIG. 14) each of which opens in a side-wise direction to receive therein a conventional mounting bracket. Each of the recesses 93 is further depressed to form therein respective generally U-shaped rearwardly opening valleys or inwardly directed ribs 95 through 98 generally centrally of which are circular recesses or depressions 101 through 104, respectively. The ribs or valleys 95 through 98 and the circular depressions 101 through 104 impart rigidity to the recesses 91 through 94, particularly relative to the fasteners 12 which pass through apertures (not shown) formed in the material of the circular recesses 101 through 104.

While preferred forms and arrangement of parts have been shown in illustrating the invention, it is to be clearly understood that various changes in details and arrangement of parts may be made without departing from the scope and spirit of this disclosure.

I claim:

1. A seat comprising a top wall merging with front, rear and a pair of opposite side walls, a bottom wall merging with said front, rear and pair of opposite side walls, said seat being of a generally one-piece homogenous plastic blow-molded construction with a parting line along said front, rear and pair of opposite side walls, and portions of said top and bottom walls being compression fused to each other adjacent said side walls thereby forming reinforced areas adapted for securement to a conventional chair seat support bracket.

2. The seat as defined in claim 1 including further portions of said top and bottom walls inboard of said first-mentioned portions being compression fused to each other inboard of said reinforced areas thereby forming additional reinforced areas to rigidify said seat.

3. The seat as defined in claim 1 including a generally U-shaped reinforcing valley formed from the material of said bottom wall opening in a direction away from said top wall, said valley having a bight and a pair of legs, said bight being adjacent said front wall, and said legs being directed toward said rear wall.

4. The seat as defined in claim 1 including a generally A-shaped reinforcing valley formed from the material of said bottom wall opening in a direction away from said top wall, said valley having a bight, a pair of legs and a cross-arm spaced from said bight, said bight being adjacent said front wall, and said legs being directed toward said rear wall.

5. The seat as defined in claim 1 including a generally A-shaped reinforcing valley formed from the material of said bottom wall opening in a direction away from said top wall, said valley having a bight, a pair of legs and a cross-arm spaced from said bight, said bight being adjacent said front wall, said legs being directed toward said rear wall, another reinforcing valley formed from the material of said bottom wall opening in a direction away from said top wall, and said another reinforcing valley being disposed adjacent said rear wall.

6. The seat as defined in claim 1 wherein said portions define recesses in said bottom wall opening in a direction away from said top wall.

7. The seat as defined in claim 1 wherein said portions define recesses in said bottom wall opening in a direction away from said top wall, and there are a plurality of said recesses in spaced relationship to each other adjacent each of said side walls.

8. The seat as defined in claim 1 wherein portions of said top, bottom, front, rear and pair of side walls define peripheral flange means at least partially bordering said seat and being directed downwardly and generally away from said top wall.

9. The seat as defined in claim 1 including aperture means in said reinforced areas adapted to receive fasteners for securing said seat to a conventional chair seat bracket.

10. The seat as defined in claim 1 including at least a pair of blow needle holes in said bottom wall.

11. The seat as defined in claim 1 including at least a pair of blow needle holes in said bottom wall disposed generally on a centerline of said bottom wall.

12. The seat as defined in claim 1 wherein said compression fused areas are disposed in angular relationship to each other adjacent each of said side walls.

13. The seat as defined in claim 1 including a generaly U-shaped reinforcing valley formed from the material of said bottom wall opening in a direction away from said top wall and being disposed between said side walls, said valley being defined by a bight and a pair of legs, said bight being adjacent said front wall, said legs being directed toward said rear wall, said bight and legs each being defined by a bight wall and spaced leg walls, and the bight walls of said legs being in converging relationship relative to said top wall in a direction toward said front wall.

14. The seat as defined in claim 1 including a generally U-shaped reinforcing valley formed from the material of said bottom wall opening in a direction away from said top wall and being disposed between said side walls, said valley being defined by a bight and a pair of legs, said bight being adjacent said front wall, said legs being directed toward said rear wall, said bight and legs each being defined by a bight wall and spaced leg walls, the bight walls of said legs being in converging relationship relative to said top wall in a direction toward said front wall, and at least portions of said bight wall being compression fused to said top wall.

15. The seat as defined in claim 3 wherein portions of said U-shaped reinforcing valley are compression fused to said top wall.

16. The seat as defined in claim 4 wherein portions of said A-shaped reinforcing valley are compression fused to said top wall.

17. The seat as defined in claim 5 wherein portions of said A-shaped reinforcing valley and said another reinforcing valley are compression fused to said top wall.

18. A back comprising front and back walls in generally spaced relationship, said front and back walls merging with top, bottom and a pair of opposite side walls and defining therewith a generally hollow chamber, said back being made of two injection molded elements, at least a pair of recesses formed by depression in the material of said back wall adjacent each side wall, and a generally U-shaped valley formed from the material of the back wall in each recess opening in a direction away from said front wall thereby reinforcing said recesses for utilizing the latter to secure said back to a conventional chair back support bracket.

19. The back as defined in claim 18 wherein said injection molded elements are joined to each other along a line of bond extending along said top, bottom and pair of opposite side walls.

20. The back as defined in claim 18 wherein said back wall includes a further depression within each U-shaped valley to form a reinforced area adapted to be apertured for the receipt therethrough of a conventional fastener.

21. The back as defined in claim 19 wherein said back wall includes a further depression within each U-shaped valley to form a reinforced area adapted to be apertured for the receipt therethrough of a conventional fastener.

22. The seat as defined in claim 1 wherein said reinforced areas are disposed in spaced relationship along each of said side walls.

23. The seat as defined in claim 1 wherein said reinforced areas are disposed in spaced relationship along each of said side walls thereby reinforcing lateral sides of said seat, and aperture means in at least one of said reinforced areas at each of said side walls adapted to receive fasteners for securing said seat to a conventional chair seat bracket.

24. The seat as defined in claim 1 wherein said reinforced areas in part defines with said sidewalls lateral side edges at each side of said seat adapted to be secured to chair seat support brackets, and said top and bottom walls at said lateral side edges being generally more closely adjacent each other than in an area between said lateral side edges.

25. The seat as defined in claim 24 wherein said reinforced areas are disposed in spaced relationship along each of said side walls.

26. The seat as defined in claim 24 wherein said reinforced areas are disposed in spaced relationship along each of said side walls thereby reinforcing lateral sides of said seat, and aperture means in at least one of said reinforced areas at each of said side walls adapted to receive fasteners for securing said seat to a conventional chair seat bracket.

* * * * *